US008303850B2

(12) United States Patent
Shibata et al.

(10) Patent No.: US 8,303,850 B2
(45) Date of Patent: Nov. 6, 2012

(54) ANTICORROSIVE OIL COMPOSITION

(75) Inventors: Junichi Shibata, Tokyo (JP); Tadaaki Motoyama, Tokyo (JP); Kazuhiko Endou, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 0 days.

(21) Appl. No.: 13/393,722

(22) PCT Filed: Jul. 14, 2010

(86) PCT No.: PCT/JP2010/061919
§ 371 (c)(1),
(2), (4) Date: May 11, 2012

(87) PCT Pub. No.: WO2011/030615

PCT Pub. Date: Mar. 17, 2011

(65) Prior Publication Data

US 2012/0217443 A1 Aug. 30, 2012

(30) Foreign Application Priority Data

Sep. 9, 2009 (JP) ..... P2009-208403

(51) Int. Cl.

| | |
|---|---|
| ***C09K 15/00*** | (2006.01) |
| ***C09K 15/02*** | (2006.01) |
| ***C09K 15/12*** | (2006.01) |
| ***C09K 15/16*** | (2006.01) |
| ***C23F 11/00*** | (2006.01) |
| ***C23F 11/12*** | (2006.01) |
| ***C23F 11/14*** | (2006.01) |
| ***C23F 11/16*** | (2006.01) |
| ***C23F 11/18*** | (2006.01) |
| ***C10M 169/04*** | (2006.01) |
| ***C10M 159/00*** | (2006.01) |
| ***C10M 135/00*** | (2006.01) |

(52) U.S. Cl. ..... 252/388; 252/389.1; 252/389.2; 252/389.62; 252/390; 252/392; 252/395; 252/399; 252/400.1; 252/401; 252/406; 508/110; 508/144; 508/145; 508/154; 508/180; 508/574; 208/18; 208/19; 208/283; 208/288; 208/290

(58) Field of Classification Search ..... 508/110, 508/144, 145, 154, 180, 459, 574; 208/18, 208/19, 282, 288, 289, 290; 252/388, 389.1, 252/389.2, 389.62, 390, 392, 399, 400.1, 252/401, 395, 406

See application file for complete search history.

(56) References Cited

U.S. PATENT DOCUMENTS

| | | | | |
|---|---|---|---|---|
| 2,520,356 | A * | 8/1950 | Bishop | 428/467 |
| 3,923,668 | A * | 12/1975 | Johnston | 508/287 |
| 3,944,397 | A * | 3/1976 | Gardiner et al. | 44/425 |
| 4,263,015 | A * | 4/1981 | Sung et al. | 44/343 |
| 5,104,558 | A * | 4/1992 | Matsuzaki | 508/220 |
| 5,318,710 | A * | 6/1994 | Campbell | 508/574 |
| 5,958,850 | A * | 9/1999 | Matsuzaki et al. | 508/435 |
| 7,776,233 | B2 * | 8/2010 | Arafat et al. | 252/395 |
| 7,906,466 | B2 * | 3/2011 | Okazaki | 508/273 |
| 7,910,528 | B2 * | 3/2011 | Okazaki | 508/273 |
| 2009/0111723 | A1 | 4/2009 | Shibata et al. | |
| 2011/0101280 | A1 * | 5/2011 | Motoyama et al. | 252/401 |
| 2012/0010111 | A1 * | 1/2012 | Shibata et al. | 508/154 |

FOREIGN PATENT DOCUMENTS

| | | |
|---|---|---|
| JP | 9-132799 | 5/1997 |
| JP | 2001-137792 | 5/2001 |
| JP | 2001-226700 | 8/2001 |
| JP | 2007-262543 | 10/2007 |
| WO | 2007/114505 | 10/2007 |

OTHER PUBLICATIONS

English language translation of International Search Report for PCT/JP2010/061919, mailed Aug. 24, 2010.

English language translation of International Preliminary Report on Patentability for PCT/JP2010/061919, mailed Apr. 19, 2012.

* cited by examiner

*Primary Examiner* — Joseph D Anthony

(74) *Attorney, Agent, or Firm* — Greenblum & Bernstein, P.L.C.

(57) ABSTRACT

A rust preventive oil composition includes at least one base oil selected from the group consisting of mineral oils and synthetic oils, having a 5%-distillation temperature of not less than 140° C. and not more than 250° C., a 95%-distillation temperature of 250° C. or less, a difference between the 5%-distillation temperature and the 95%-distillation temperature of 90° C. or less, an aromatic content of 5% by volume or less, a naphthene content of not less than 30% by volume and not more than 95% by volume, a density at 15° C. of 0.75 g/cm$^3$ or more, and a kinematic viscosity at 40° C. of not less than 0.3 mm$^2$/s and not more than 5.0 mm$^2$/s; at least one base oil selected from the group consisting of mineral oils and synthetic oils; and a rust-preventing additive.

3 Claims, No Drawings

ANTICORROSIVE OIL COMPOSITION

TECHNICAL FIELD

The present invention relates to a rust preventive oil composition.

BACKGROUND ART

The standard of rust preventive oils is prescribed in JIS K2246, and the rust preventive oils are categorized into five types: a fingerprint remover type; a solvent cutback type; a petrolatum type; a lubricant oil type; and a volatile rust preventive oil. Further, three types except for the fingerprint removal type and the petrolatum type are further categorized into specific types depending on intended purposes and properties.

The rust preventive oils of the solvent dilution type, the fingerprint removal type, and the like contain a solvent, and exhibit a high rust preventive property when the solvent volatilizes and viscosity of an oil film itself increases or when the concentration of an additive, if contained, in an applied oil film increases. As the solvent of these rust preventive oils, kerosene which is easily available and cheap is widely used (for example, see Patent Literature 1). Further, alkylbenzene having high washability may be used (see Patent Literatures 2 and 3).

CITATION LIST

Patent Literature

[Patent document 1] Japanese Patent Application Laid-Open No. 9-132799

[Patent document 2] Japanese Patent Application Laid-Open No. 2001-226700

[Patent document 3] Japanese Patent Application Laid-Open No. 2007-262543

SUMMARY OF INVENTION

Technical Problem

However, hydrocarbons with a high volatility such as kerosene have peculiar smell, which is enhanced when an aromatic component is contained therein, and further may cause skin problems. Moreover, kerosene has a low flash point of around 50° C., and thus has a risk that volatilized vapor catches fire or the like.

By the way, as for benzene which is an aromatic compound, there is a regulation for its content according to the "Ordinance on Prevention of Hazards due to Specified Chemical Substances and Ordinance on the Prevention of Organic Solvent Poisoning" of the Occupational Safety and Health Act. Further, among aromatic compounds other than benzene, toluene, xylene, trimethylbenzene, and the like are often considered to be problematic in terms of environment and safety. Moreover, some of polycyclic aromatics are confirmed to have carcinogenicity.

Further, alkylbenzene as described in Patent Literatures 2 and 3 has a low harmful effect, but may have problems with smell and skin irritation in some cases.

On the other hand, if a material obtained by increasing a degree of refining in producing kerosene to remove an aromatic content is used as a solvent, such a problem may be caused that stability as a rust preventive oil is impaired or that rust preventive performance decreases. It can be presumed that this would be caused by a decrease in solubility due to the loss of the aromatic content, but if a distillate with a lower boiling point is used as a solvent to solve this problem, the flash point also decreases, which causes a problem of safety.

The present invention is accomplished in view of such circumstances, and its object is to provide a rust preventive oil composition containing a solvent, which has a high rust preventive property and which hardly causes deterioration of working environment such as smell and skin problems and concerns for safety such as inflammation.

Solution to Problem

In order to solve the above problems, the present invention provides a rust preventive oil composition comprising: at least one base oil (hereinafter, referred to as a "first base oil" in some cases) selected from the group consisting of mineral oils and synthetic oils, having a 5%-distillation temperature of not less than 140° C. and not more than 250° C., a 95%-distillation temperature of 250° C. or less, a difference between the 5%-distillation temperature and the 95%-distillation temperature of 90° C. or less, an aromatic content of 5% by volume or less, a naphthene content of not less than 30% by volume and not more than 95% by volume, a density at 15° C. of 0.75 g/cm$^3$ or more, and a kinematic viscosity at 40° C. of not less than 0.3 mm$^2$/s and not more than 5.0 mm$^2$/s; at least one base oil (hereinafter, referred to as a "second base oil" in some cases) selected from the group consisting of mineral oils and synthetic oils, having a 5%-distillation temperature is 260° C. or more, and a kinematic viscosity at 40° C. is not less than 6.0 mm$^2$/s but not more than 500 mm$^2$/s; and a rust-preventing additive.

In the present invention, the rust-preventing additive may be at least one selected from sulfonates and esters.

Further, the kinematic viscosity at 40° C. of the rust preventive oil composition of the present invention may be not less than 0.5 mm$^2$/s and not more than 30 mm$^2$/s.

Advantageous Effects of Invention

According to the present invention, it is possible to realize a rust preventive oil composition containing a solvent, which has a high rust preventive property and which hardly causes deterioration of working environment such as smell and skin problems and concerns for safety such as inflammation. The rust preventive oil composition of the present invention having such excellent characteristics is very useful for rust prevention of metallic parts after metal processing in a production step of various metallic parts such as steel plates, bearings, steel spheres, and guide rails.

DESCRIPTION OF EMBODIMENTS

Hereinafter, a preferred embodiment of the present invention is described in detail.

A first base oil contained in a rust preventive oil composition of the present invention is at least one base oil selected from the group consisting of mineral oils and synthetic oils where a 5%-distillation temperature is not less than 140° C. but not more than 250° C., a difference between the 5%-distillation temperature and 95%-distillation temperature is 90° C. or less, an aromatic content is 5% by volume or less, a naphthene content is not less than 30% by volume but not more than 95% by volume, a density at 15° C. is 0.75 g/cm$^3$ or more, and a kinematic viscosity at 40° C. is not less than 0.3 mm$^2$/s but not more than 5.0 mm$^2$/s.

Examples of the mineral oils and the synthetic oil include: kerosene fractions obtained by distillation of paraffin-base or naphthenic crude oil; normal paraffins obtained by extraction operation or the like from a kerosene fraction; and a paraffin mineral oil, a naphthenic mineral oil, a normal paraffin base oil, an isoparaffin base oil, and the like obtained by refining by appropriately combining one or two or more of refining treatments such as solvent deasphalting, solvent extraction, hydrocracking, hydrogenation isomerization, solvent dewaxing, catalytic dewaxing, hydrorefining, sulfuric acid washing, and clay treatment by using, as a raw material, a lubricant oil fraction obtained by distillation of a paraffin-base or naphthenic crude oil, or a wax such as a slack wax obtained by a dewaxing step of a lubricant oil and/or a synthetic wax such as a Fischer-Tropsch wax or a GTL wax obtained by a gas-to-liquid (GTL) process or the like. Among these, one for which the 5%-distillation temperature, the difference between the 5%-distillation temperature and 95%-distillation temperature, the aromatic content, the naphthene content, the density at 15° C., and the kinematic viscosity at 40° C. satisfy the above conditions is used as the first base oil.

The 5%-distillation temperature of the first base oil is 140° C. or more, preferably 150° C. or more, more preferably 155° C. or more, and most preferably 160° C. or more. Further, the 95%-distillation temperature is 250° C. or less, preferably 240° C. or less, more preferably 230° C. or less, and most preferably 220° C. or less. If the 5%-distillation temperature is less than 140° C., the smell cannot be restrained sufficiently. Further, if the 5%-distillation temperature exceeds 250° C., a sufficient rust preventive property cannot be obtained.

The difference between the 5%-distillation temperature and the 95%-distillation temperature of the first base oil is 90° C. or less, preferably 70° C. or less, more preferably 50° C. or less, and most preferably 30° C. or less. If the difference between the 5%-distillation temperature and the 95%-distillation temperature exceeds 90° C., a sufficient rust preventive property cannot be obtained.

Here, the 5%-distillation temperature and the 95%-distillation temperature of the first base oil mean values measured in accordance with the atmospheric pressure method in JIS K 2254, "Petroleum products—Determination of distillation characteristics."

The aromatic content of the first base oil is 5% by volume or less, preferably 3% by volume or less, more preferably 2% by volume, and most preferably 1% or less. If the aromatic content exceeds 5% by volume, the smell and skin irritation cannot be restrained sufficiently. Here, the aromatic content means a value measured in accordance with the fluorescent indicator adsorption method in JIS K 2536-1996, "Liquid petroleum products—Testing method of components."

The naphthene content of the first base oil is 30% by volume or more, preferably 35% by volume or more, more preferably 40% by volume, and most preferably 45% by volume. Further, the naphthene content is 95% by volume or less, preferably 80% by volume or less, more preferably 75% by volume, and most preferably 70% by volume. If the naphthene content is less than 30% by volume, the stability of an oil formulation is impaired. Further, if the naphthene content exceeds 80% by volume, the smell cannot be restrained sufficiently, and further dissolution of an organic material is caused.

Here, the naphthene content is determined such that molecular ion strengths are obtained by mass spectrometry by FI ionization (using a glass reservoir) and their proportions are defined based on % by volume. The following describes the measurement method more specifically.

(1) Into a suction tube for elution chromatography with a diameter of 18 mm and a length of 980 mm, 120 g of silica gel (grade 923 made by Fuji-Davison Chemical Ltd.) with a nominal diameter of 74 to 149 μm which has been activated by drying at about 175° C. for 3 hours is filled.

(2) Then, 75 mL of n-pentane is poured to moisten the silica gel beforehand.

(3) About 2 g of a sample is precisely weighed, diluted with an equal volume of n-pentane, and an obtained sample solution is injected.

(4) When a liquid level of the sample solution reaches an upper end of the silica gel, 140 mL of n-pentane is injected in order to separate a saturated hydrocarbon component, and an effluent is collected from a bottom end of the suction tube.

(5) The effluent is placed in a rotary evaporator to remove a solvent, and the saturated hydrocarbon component is obtained.

(6) The saturated hydrocarbon component is subjected to type analysis with a mass spectrometer. As an ionization method in the mass spectrometry, an FI ionization method using a glass reservoir is used, and as the mass spectrometer, JMS-AX505H made by JEOL Ltd. is used.

Measurement conditions are as follows: accelerating voltage: 3.0 kV, cathode voltage: −5 to −6 kV, resolution: about 500, emitter: carbon, emitter current: 5 mA, measuring range: 35 to 700 in mass number, auxiliary oven temperature: 300° C., separator temperature: 300° C., main oven temperature: 350° C., and sample injection volume: 1 μl.

After isotope correction is performed on the molecular ions obtained by the mass spectrometry, they are categorized/sorted into two types, i.e., paraffins ($C_nH_{2n+2}$) and naphthenes ($C_nH_{2n}$, $C_nH_{2n-2}$, $C_nH_{2n-4}$ . . . ) depending on the mass number thereof and respective ionic strength fractions thereof are determined to obtain a content of each type with respect to a whole saturated hydrocarbon component. Subsequently, based on the content of the saturated hydrocarbon component, a content of the naphthene content with respect to the whole sample is obtained.

Note that details of data processing by the type analysis method of the FI mass spectrometry are described in "Nisseki Review," Vol. 33, No. 4, pages 135 to 142, particularly, a section of "2.2.3 Data Processing."

The density of the first base oil at 15° C. is 0.75 g/cm$^3$ or more, preferably 0.76 g/cm$^3$ or more, and more preferably 0.77 g/cm$^3$ or more. If the density at 15° C. is less than 0.75 g/cm$^3$, the smell and skin irritation cannot be restrained sufficiently. Here, the density means a value measured in accordance with JIS K 2249-1995 "Crude petroleum and petroleum products—Determination of density and petroleum measurement tables based on a reference temperature (15 centigrade degrees)."

The kinematic viscosity at 40° C. of the first base oil is 0.3 mm$^2$/s or more, preferably 1.0 mm$^2$/s or more, more preferably 1.5 mm$^2$/s or more, and most preferably 2.0 mm$^2$/s or more. Further, the kinematic viscosity at 40° C. of the first base oil is 5.0 mm$^2$/s or less, preferably 4.5 mm$^2$/s or less, more preferably 4.0 mm$^2$/s or less, and most preferably 3.5 mm$^2$/s or less. If the kinematic viscosity at 40° C. is less than 0.3 mm$^2$/s, the smell and skin irritation cannot be restrained sufficiently, and if the kinematic viscosity exceeds 5.0 mm$^2$/s, the rust preventive property is degraded, which is unfavorable. Here, the kinematic viscosity at 40° C. of the first base oil means a value measured in accordance with JIS K 2283-2000, "Crude petroleum and petroleum products—Determination of kinematic viscosity and calculation of viscosity index from kinematic viscosity."

An amount of the first base oil to be formulated is preferably 30% by mass, more preferably 40% by mass or more, and most preferably 50% by mass or more based on a total mass of the composition. Further, the amount of the first base oil to be formulated is preferably 95% by mass or less, more preferably 90% by mass or less, and most preferably 85% by mass or less based on the total mass of the composition. If the amount of the first base oil to be formulated is less than 30% by mass, a sufficient rust preventive property cannot be obtained, and if the amount of the first base oil to be formulated exceeds 95% by mass, a coating amount of the oil formulation decreases, thereby making it difficult to obtain a sufficient rust preventive property.

Further, the second base oil contained in the rust preventive oil composition of the present invention is at least one base oil selected from the group consisting of mineral oils and synthetic oils where a 5%-distillation temperature is 260° C. or more, and a kinematic viscosity at 40° C. is not less than 6.0 $mm^2/s$ but not more than 500 $mm^2/s$.

Examples of the mineral oils and the synthetic oils include: kerosene fractions obtained by distillation of paraffin-base or naphthenic crude oil; normal paraffins obtained by extraction operation or the like from a kerosene fraction; and a paraffin mineral oil, a naphthenic mineral oil, a normal paraffin base oil, an isoparaffin base oil, and the like obtained by refining by appropriately combining one or two or more of refining treatments such as solvent deasphalting, solvent extraction, hydrocracking, hydrogenation isomerization, solvent dewaxing, catalytic dewaxing, hydrorefining, sulfuric acid washing, and clay treatment by using, as a raw material, a lubricant oil fraction obtained by distillation of a paraffin-base or naphthenic crude oil, or a wax such as a slack wax obtained by a dewaxing step of a lubricant oil and/or a synthetic wax such as a Fischer-Tropsch wax or a GTL wax obtained by a gas-to-liquid (GTL) process or the like. Among these, one for which the 5%-distillation temperature and the kinematic viscosity at 40° C. satisfy the above conditions is used as the second base oil.

The 5%-distillation temperature of the second base oil is 260° C. or more, preferably 270° C. or more, more preferably 280° C. or more, and most preferably 290° C. or more. If the 5%-distillation temperature is less than 260° C., a sufficient rust preventive property cannot be obtained. Here, the 5%-distillation temperature of the second base oil means a value measured in accordance with the gas chromatography in JIS K 2254, "Petroleum products—Determination of distillation characteristics."

The kinematic viscosity at 40° C. of the second base oil is 6.0 $mm^2/s$ or more, preferably 8.0 $mm^2/s$ or more, more preferably 10 $mm^2/s$ or more, and most preferably 12 $mm^2/s$ or more. Further, the kinematic viscosity at 40° C. of the second base oil is 500 $mm^2/s$ or less, preferably 300 $mm^2/s$ or less, more preferably 200 $mm^2/s$ or less, and most preferably 120 $mm^2/s$ or less. If the kinematic viscosity at 40° C. is less than 6.0 $mm^2/s$, a rust preventive property improvement effect is insufficient, and if the kinematic viscosity at 40° C. exceeds 500 $mm^2/s$, the stability of the oil formulation decreases. Here, the kinematic viscosity at 40° C. of the second base oil means a value measured in accordance with JIS K 2283-2000, "Crude petroleum and petroleum products—Determination of kinematic viscosity and calculation of viscosity index from kinematic viscosity."

The amount of the second base oil to be formulated is preferably 0.5% by mass, more preferably 1.0% by mass or more, and most preferably 2.0% by mass or more based on the total mass of the composition. Further, the amount of the second base oil to be formulated is preferably 30% by mass or less, more preferably 27% by mass or less, and most preferably 25% by mass or less based on the total mass of the composition. If the amount to be formulated is less than 0.5% by mass, a nonvolatile content decreases after application of the oil solution so that a sufficient rust preventive property cannot be obtained, and if the amount to be formulated exceeds 30% by mass, an additive concentration after the application of the oil formulation is insufficient so that a sufficient rust preventive property cannot be obtained.

The kinematic viscosity at 40° C. of the rust preventive oil composition of the present invention is 0.5 $mm^2/s$ or more, preferably 0.7 $mm^2/s$ or more, more preferably 1.0 $mm^2/s$ or more, and most preferably 1.5 $mm^2/s$ or more. Further, the kinematic viscosity at 40° C. of the rust preventive oil composition of the present invention is 30 $mm^2/s$ or less, preferably 25 $mm^2/s$ or less, more preferably 20 $mm^2/s$ or less, and most preferably 15 $mm^2/s$ or less. If the kinematic viscosity at 40° C. of the rust preventive oil composition of the present invention is less than 0.5 $mm^2/s$, a sufficient rust preventive property cannot be obtained, and further, a volatilization amount during the handling is excessive, which impairs work environments. Further, if the kinematic viscosity at 40° C. exceeds 30 $mm^2/s$, working properties in an application step and the like are worsened, which makes it difficult to remove the oil formulation by degreasing or the like in a subsequent step. Here, the kinematic viscosity at 40° C. of the rust preventive oil composition means a value measured in accordance with JIS K 2283-2000, "Crude petroleum and petroleum products—Determination of kinematic viscosity and calculation of viscosity index from kinematic viscosity."

A flash point of the rust preventive oil composition of the present invention is not particularly limited, but is preferably 70° C. or more, more preferably 80° C. or more, and most preferably 90° C. or more. Note that the measurement of the flash point is in accordance with JIS K2265-1996, "Crude oil and petroleum products—Determination of flash point," and is performed by the Cleveland open cup method in a case of 80° C. or more while being performed by the Pensky-Martens closed cup method in a case of less than 80° C.

Further, the rust preventive oil composition of the present invention contains a rust-preventing additive. Examples of the rust-preventing additive include (A) sulfonates, (B) esters, (C) sarcosine compounds, (D) nonionic surfactants, (E) amines, (F) carboxylic acids, (G) aliphatic amine salts, (H) carboxylates, (I) paraffin waxes, (J) salts of oxidized wax, (K) boron compounds, (L) alkyl or alkenyl succinic acid derivatives, and the like, and particularly, it is preferable to contain one or more selected from the group consisting of (A) sulfonates and (B) esters.

Preferable examples of the (A) sulfonates as used in the present invention are alkali metal salts of sulfonic acids, alkaline earth metal salts of sulfonic acids, or amine salts of sulfonic acids. Every sulfonate has sufficiently high safety to a human body and the ecosystem, and can be obtained by reacting an alkali metal, an alkaline earth metal, or an amine with a sulfonic acid.

Examples of the alkali metals constituting the (A) sulfonates include sodium, potassium, and the like. Further, examples of the alkaline earth metals include magnesium, calcium, barium, and the like. Among them, as the alkali metal and alkaline earth metal, sodium, potassium, calcium, and barium are preferable, and calcium is particularly preferable.

In a case where the (A) sulfonates are amine salts, examples of the amines include a monoamine, a polyamine, an alkanolamine, and the like.

Examples of the monoamine include an alkylamine having 1 to 3 alkyl groups with a carbon number of 1 to 22, an alkenyl amine having an alkenyl group with a carbon number of 2 to 23, a monoamine having 2 methyl groups and 1 alkenyl group with a carbon number of 2 to 23, an aromatic substituted alkylamine, a cycloalkylamine having a cycloalkyl group with a carbon number of 5 to 16, a monoamine having 2 methyl groups and a cycloalkyl group, and an alkylcycloalkylamine having a cycloalkyl group in which a methyl group and/or an ethyl group is substituted. The monoamine as used herein includes monoamines such as tallow amines derived from oils and fats.

Examples of the polyamine include an alkylene polyamine having 1 to 5 alkylene groups with a carbon number of 2 to 4, an N-alkyl ethylene diamine having an alkyl group with a carbon number of 1 to 23, an N-alkenyl ethylene diamine having an alkenyl group with a carbon number of 2 to 23, and an N-alkyl or N-alkenyl alkylene polyamine. The polyamine as used herein includes polyamines (tallow polyamines and the like) derived from oils and fats.

Examples of the alkanolamine include mono-, di-, and tri-alkanolamines of alcohols with a carbon number of 1 to 16.

As the sulfonic acids constituting the (A) sulfonates, those which are well-known and produced by a conventional method can be used. More specifically, general examples thereof include synthetic sulfonic acid and the like such as: one obtained by sulfonating an alkyl aromatic compound of a lubricant oil fraction of a mineral oil; a petroleum sulfonic acid such as what is called a mahogany acid by-produced at the time of producing white oil; one obtained by sulfonating that alkylbenzene having a linear or branched alkyl group which is obtained by alkylating, into benzene, polyolefin by-produced from an alkylbenzene production plant which is a raw material for a detergent or the like; and one obtained by sulfonating alkyl naphthalene such as dinonyl naphthalene.

Examples of the sulfonates obtained by using the above raw materials are as follows: an alkali metal base such as an oxide or hydroxide of an alkaline metal; a neutral (normal salt) sulfonate obtained by reacting an alkaline earth metal base such as an oxide or hydroxide of an alkaline earth metal, or an amine such as ammonia, alkylamine, or alkanolamine with a sulfonic acid; a basic sulfonate obtained by heating the neutral (normal salt) sulfonate with an excessive amount of an alkali metal base, an alkaline earth metal base, or an amine in the presence of water; a carbonate overbased (ultrabasic) sulfonate obtained by reacting the neutral (normal salt) sulfonate with an alkali metal base, an alkaline earth metal base, or an amine in the presence of carbon dioxide gas; a borate overbased (ultrabasic) sulfonate obtained by reacting the neutral (normal salt) sulfonate with an alkali metal base, an alkaline earth metal base, or an amine, and a boric acid compound such as a boric acid or an anhydrous boric acid, or obtained by reacting the above carbonate overbased (ultrabasic) sulfonate with a boric acid compound such as a boric acid or an anhydrous boric acid; or mixtures thereof.

In the present invention, it is more preferable to use one or two or more selected from neutral, basic, overbased alkali metal sulfonates and alkaline earth metal sulfonates among them; and it is particularly preferable to use an alkali metal sulfonate or an alkaline earth metal sulfonate which is neutral or close to neutral with a base number of 0 to 50 mgKOH/g, preferably 10 to 30 mgKOH/g, and/or a basic (overbased) alkali metal sulfonate or an alkaline earth metal sulfonate with a base number of 50 to 500 mgKOH/g, preferably 200 to 400 mgKOH/g. Further, a mass ratio of the alkali metal sulfonate or alkaline earth metal sulfonate with a base number of 0 to 50 mgKOH/g to the alkali metal sulfonate or alkaline earth metal sulfonate with a base number of 50 to 500 mgKOH/g (the alkali metal sulfonate or alkaline earth metal sulfonate with a base number of 0 to 50 mgKOH/g/the alkali metal sulfonate or alkaline earth metal sulfonate with a base number of 50 to 500 mgKOH/g) is preferably 0.1 to 30, more preferably 1 to 20, and particularly preferably 1.5 to 15 based on the total mass of the composition.

Here, the base number mean a base number measured generally in a state where a diluent such as a lubricant oil base oil is contained by 30 to 70% by mass by the hydrochloric acid method in accordance with the item 6 in JIS K 2501, "Petroleum products and lublicants—Determination of neutralization number."

As the (A) sulfonate, an amine sulfonate, a calcium sulfonate, a barium sulfonate, and a sodium sulfonate are preferable, and an alkylenediamine sulfonate and a calcium sulfonate are particularly preferable.

An amount of the (A) sulfonate to be formulated in the rust preventive oil composition of the present invention is not particularly limited, but is preferably 0.1% by mass or more, more preferably 0.5% by mass or more, further preferably 1.0% by mass or more, and most preferably 2.0% by mass based on the total mass of the composition. Further, it is preferably 35% by mass or less, more preferably 30% by mass or less, further preferably 25% by mass by mass, and most preferably 20% by mass based on the total mass of the composition.

Preferable examples of the (B) esters as used herein are (B1) a partial ester of a polyalcohol, (B2) an esterified oxidized wax, (B3) an esterified lanolin fatty acid, (B4) an alkyl or alkenyl succinate ester, and the like. These compounds can improve a rust preventive property more.

The (B1) partial ester of a polyalcohol means an ester in which at least one or more of hydroxyl groups in the polyalcohol is not esterified and remains as the hydroxyl group, and although any polyalcohol may be used as the raw material, a polyalcohol in which the number of hydroxyl groups in a molecule is preferably 2 to 10, and more preferably 3 to 6, and a carbon number is 2 to 20, and more preferably 3 to 10 is preferably used. Among these polyalcohols, it is preferable to use at least one polyalcohol selected from the group consisting of glycerin, trimethylolethane, trimethylolpropane, pentaerythritol, and sorbitan, and it is more preferable to use pentaerythritol.

Meanwhile, although any carboxylic acid may be used as a carboxylic acid that constitutes the partial ester, a carbon number of the carboxylic acid is preferably 2 to 30, more preferably 6 to 24, and further preferably 10 to 22. Furthermore, the carboxylic acid may be a saturated carboxylic acid or an unsaturated carboxylic acid, and a linear carboxylic acid or a branched carboxylic acid.

As the carboxylic acid that constitutes the partial ester, a hydroxycarboxylic acid may be used. Although the hydroxycarboxylic acid may be a saturated carboxylic acid or an unsaturated carboxylic acid, a saturated carboxylic acid is preferable in terms of stability. Furthermore, the hydroxycarboxylic acid may be a linear carboxylic acid or a branched carboxylic acid; however, the hydroxycarboxylic acid is preferably a linear carboxylic acid or a branched carboxylic acid having 1 to 3, more preferably 1 to 2, and particularly preferably 1 side chain with a carbon number of 1 or 2, more preferably 1, i.e., methyl group.

The carbon number of the hydroxycarboxylic acid is preferably 2 to 40, more preferably 6 to 30, and further preferably 8 to 24 to provide both a rust preventive property and storage stability. The number of carboxylic acid groups in the hydroxycarboxylic acid is not particularly limited, and the hydroxycarboxylic acid may be either a monobasic acid or a polybasic acid; however, a monobasic acid is preferable. Although the number of hydroxyl groups in the hydroxycarboxylic acid is not particularly limited, the number is preferably 1 to 4, more preferably 1 to 3, further preferably 1 to 2, and particularly preferably 1 in terms of stability.

A hydroxyl group may be bound at any position in the hydroxycarboxylic acid; however, the hydroxycarboxylic acid is preferably a carboxylic acid (α-hydroxy acid) in which a hydroxyl group is bound to a carbon atom to which a carboxylic acid group is bound or a carboxylic acid (ω-hydroxy acid) in which a hydroxyl group is bound to a carbon atom at the other end of a main chain when viewed from a carbon atom to which a carboxylic acid group is bound.

As a raw material that contains such a hydroxycarboxylic acid, a lanolin fatty acid obtained by refining a waxy material that adheres to wool by hydrolysis or the like can be preferably used. When the hydroxycarboxylic acid is used as a constituent carboxylic acid of the partial ester, a carboxylic acid having no hydroxyl group may be used in combination.

The carboxylic acid having no hydroxyl group may be a saturated carboxylic acid or an unsaturated carboxylic acid. Among carboxylic acids having no hydroxyl group, the saturated carboxylic acid may be a linear carboxylic acid or a branched carboxylic acid; however, the saturated carboxylic acid is preferably a linear carboxylic acid or a branched carboxylic acid having 1 to 3, more preferably 1 to 2, and further preferably 1 side chain with a carbon number of 1 or 2, more preferably 1, i.e., methyl group.

The number of carboxylic acid groups in the unsaturated carboxylic acid having no hydroxyl group is not particularly limited, and the unsaturated carboxylic acid may be either a monobasic acid or a polybasic acid; however, a monobasic acid is preferable. Although the number of unsaturated bonds in the unsaturated carboxylic acid which having no hydroxyl group is not particularly limited, the number is preferably 1 to 4, more preferably 1 to 3, further preferably 1 to 2, and particularly preferably 1 in terms of stability. Among the unsaturated carboxylic acids which having no hydroxyl group, a linear unsaturated carboxylic acid with a carbon number of 18 to 22 such as an oleic acid is preferable in terms of the rust preventive property and solubility in the base oil, and further, a branched unsaturated carboxylic acid with a carbon number of 18 to 22 such as an isostearic acid is preferable in terms of oxidation stability, solubility in the base oil, and stain resistance, and an oleic acid is particularly preferable.

In the partial ester of a polyalcohol and a carboxylic acid, a percentage of an unsaturated carboxylic acid within a constituent carboxylic acid is preferably 5 to 95% by mass. When the percentage of the unsaturated carboxylic acid is 5% by mass or more, the rust preventive property and storage stability can be further improved. The percentage of the unsaturated carboxylic acid is more preferably 10% by mass or more, further preferably 20% by mass or more, still more preferably 30% by mass or more, and particularly preferably 35% by mass or more for similar reasons. In the meantime, if the percentage of the unsaturated carboxylic acid exceeds 95% by mass, resistance to atmospheric exposure and solubility in the base oil tend to be insufficient. The percentage of the unsaturated carboxylic acid is more preferably 80% by mass or less, further preferably 60% by mass or less, and particularly preferably 50% by mass or less for similar reasons.

When the above partial ester is a partial ester in which the percentage of the unsaturated carboxylic acid within the constituent carboxylic acid is 5 to 95% by mass, an iodine value of the partial ester is preferably 5 to 75, more preferably 10 to 60, and further preferably 20 to 45. If the iodine value of the partial ester is less than 5, the rust preventive property and storage stability tend to decrease. Further, if the iodine value of the partial ester exceeds 75, resistance to atmospheric exposure and solubility in the base oil tend to decrease. The "iodine value" used in the present invention means an iodine value measured by the indicator titration method in accordance with JIS K 0070 "Acid value, saponification value, iodine value, hydroxyl value and unsaponification value of chemical products."

The (B2) esterified oxidized wax indicates a wax obtained by reacting an oxidized wax with alcohols, thereby esterifying some or all of the acidic groups in the oxidized wax. Examples of the oxidized wax used as a raw material for the esterified oxidized wax include an oxidized wax, and examples of the alcohols used as a raw material for the esterified oxidized wax include a linear or branched saturated monohydric alcohol with a carbon number of 1 to 20, a linear or branched unsaturated monohydric alcohol with a carbon number of 1 to 20, polyalcohols exemplified in the description of the above esters, and an alcohol obtained by hydrolysis of lanolin, and the like.

The (B3) esterified lanolin fatty acid indicates one obtained by reacting a lanolin fatty acid obtained by refining a waxy material that adheres to wool by hydrolysis or the like, with an alcohol. Examples of the alcohol used as a raw material for the esterified lanolin fatty acid include the alcohols exemplified in the description of the above esterified oxidized wax, and among them, polyalcohols are preferable, and trimethylolpropane, trimethylolethane, sorbitan, pentaerythritol, and glycerin are more preferable. Examples of the above alkyl or alkenyl succinate ester include esters of the above alkyl or alkenyl succinic acid and a monohydric alcohol or a dihydric or higher polyalcohol. Among them, esters of a monohydric alcohol or a dihydric alcohol are preferable.

The monohydric alcohol may be linear or branched, and may also be a saturated alcohol or an unsaturated alcohol. Furthermore, although the carbon number of the monohydric alcohol is not particularly limited, an aliphatic alcohol with a carbon number of 8 to 18 is preferable. As the dihydric alcohol, an alkylene glycol and a polyoxyalkylene glycol are preferably used.

The (B4) alkyl or alkenyl succinate ester may be a diester (complete ester) in which both of the two carboxyl groups in an alkyl or alkenyl succinic acid are esterified, or a monoester (partial ester) in which either one of the carboxyl groups is esterified, but the monoester is preferable in terms of a better rust preventive property. The alkenyl group herein may have any carbon number, but generally, one with a carbon number of 8 to 18 is used.

Further, an alcohol which constitutes the ester may be a monohydric alcohol, or a dihydric alcohol or higher polyalcohol, but a monohydric alcohol and a dihydric alcohol are preferable. As the monohydric alcohol, an aliphatic alcohol with a carbon number of 8 to 18 is generally used. Further, it may be linear or branched, and may also be a saturated alcohol or an unsaturated alcohol. Further, as the dihydric alcohol, an alkylene glycol and a polyoxyalkylene glycol are generally used. It should be noted that when a polyoxyalkylene glycol includes copolymerized alkylene oxides having different structures, the form of polymerization of oxyalkylene groups is not particularly limited, and they may be polymerized by a random copolymerization or a block copolymerization. The degree of polymerization is not particularly limited, but is preferably 2 to 10, more preferably 2 to 8, and further preferably 2 to 6.

Among these esters, the use of the (B1) partial ester of a polyalcohol is particularly preferable since the partial ester exhibits a better rust preventive property, and specific examples thereof include pentaerythritol ester of lanolin, sorbitan monooleate, and sorbitan isostearate.

An amount of the (B) ester to be formulated in the rust preventive oil composition of the present invention is not particularly limited, but is preferably 0.1% by mass or more, more preferably 0.5% by mass or more, further preferably 0.7% by mass or more, and most preferably 1.0% by mass or more based on the total mass of the composition. Further, the amount of the (B) ester to be formulated is preferably 30% by mass or less, more preferably 25% by mass or less, further preferably 20% by mass or less, and most preferably 15% by mass or less based on the total mass of the composition.

Moreover, the composition of the present invention may further contain one or more compounds selected from the group consisting of (C) a sarcosine compound, (D) a nonionic surfactant, (E) an amine, (F) a carboxylic acid, (G) a fatty acid amine salt, (H) a carboxylate, (I) a paraffin wax, (J) a salt of oxidized wax, (K) a boron compound, (L) an alkyl or alkenyl succinic acid derivative, and (M) water. Among these compounds, it is particularly preferable to use the (C) sarcosine compound, the (D) nonionic surfactant, and the (G) fatty acid amine salt. Further, when washability such as fingerprint removability is given, it is preferable to use the (M) water in addition to them.

The (C) sarcosine compound has a structure represented by the following formula (1), (2), or (3):

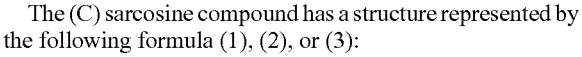

$$R^1—CO—NR^2—(CH_2)_n—COOX \quad (1)$$

(wherein $R^1$ represents an alkyl group with a carbon number of 6 to 30 or an alkenyl group with a carbon number of 6 to 30; $R^2$ represents an alkyl group with a carbon number of 1 to 4; X represents a hydrogen atom, an alkyl group with a carbon number of 1 to 30, or an alkenyl group with a carbon number of 1 to 30; and n represents an integer of 1 to 4);

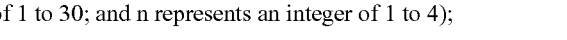

$$[R^1—CO—NR^2—(CH_2)_n—COO]_mY \quad (2)$$

(wherein $R^1$ represents an alkyl group with a carbon number of 6 to 30 or an alkenyl group with a carbon number of 6 to 30; $R^2$ represents an alkyl group with a carbon number of 1 to 4; Y represents an alkali metal or an alkaline earth metal; n represents an integer of 1 to 4; and m represents 1 if Y is an alkali metal, and represents 2 if Y is an alkaline earth metal); and

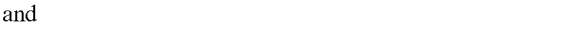

$$[R^1—CO—NR^2—(CH_2)_n—COO]_m—Z—(OH)_{m'} \quad (3)$$

(wherein $R^1$ represents an alkyl group with a carbon number of 6 to 30 or an alkenyl group with a carbon number of 6 to 30; $R^2$ represents an alkyl group with a carbon number of 1 to 4; Z represents a residue other than hydroxyl groups of a dihydric or higher polyalcohol; m represents an integer of 1 or more; m' represents an integer of 0 or more; m+m' represents a valence of Z; and n represents an integer of 1 to 4).

In the formulas (1) to (3), $R^1$ represents an alkyl group with a carbon number of 6 to 30 or an alkenyl group with a carbon number of 6 to 30. In terms of solubility in the base oil, and the like, it is necessary that $R^1$ be an alkyl group or alkenyl group with a carbon number of 6 or more, and the carbon number is preferably 7 or more, and more preferably 8 or more. Further, in terms of storage stability and the like, $R^1$ has to be an alkyl group or alkenyl group with a carbon number of 30 or less, and the carbon number is preferably 24 or less, and more preferably 20 or less. These alkyl groups or alkenyl groups may be either linear or branched, and further, the alkenyl groups may have a double bond at any position.

In the formulas (1) to (3), $R^2$ represents an alkyl group with a carbon number of 1 to 4. In terms of storage stability and the like, $R^2$ has to be an alkyl group with a carbon number of 4 or less, and the carbon number is preferably 3 or less, and more preferably 2 or less. In the formulas (1) to (3), n represents an integer of 1 to 4. In terms of storage stability and the like, n has to be an integer of 4 or less, and n is preferably 3 or less, and more preferably 2 or less.

In the formula (1), X represents a hydrogen atom, an alkyl group with a carbon number of 1 to 30, or an alkenyl group with a carbon number of 1 to 30. In terms of storage stability and the like, an alkyl group or alkenyl group represented by X has to be one with a carbon number of 30 or less, and the carbon number is preferably 20 or less, and more preferably 10 or less. These alkyl groups or alkenyl groups may be linear or branched, and the alkenyl groups may have a double bond at any position.

Furthermore, in terms of a better rust preventive property and the like, an alkyl group is more preferable. In terms of a better rust preventive property and the like, X is preferably a hydrogen atom, an alkyl group with a carbon number of 1 to 20, or an alkenyl group with a carbon number of 1 to 20, more preferably a hydrogen atom or an alkyl group with a carbon number of 1 to 20, and even more preferably a hydrogen atom or an alkyl group with a carbon number of 1 to 10.

In the formula (2), Y represents an alkali metal or an alkaline earth metal, and specific examples thereof include sodium, potassium, magnesium, calcium, and barium, and the like. Among these, an alkaline earth metal is preferable in terms of a better rust preventive property. It should be noted that barium may cause insufficient safety to a human body or the ecosystem. In the formula (2), m represents 1 if Y is an alkali metal, and represents 2 if Y is an alkaline earth metal.

In the formula (3), Z represents a residue other than hydroxyl groups of a dihydric or higher polyalcohol. Examples of such polyalcohols include dihydric alcohols to hexahydric alcohols.

In the formula (3), m represents an integer of 1 or more, m' represents an integer of 0 or more, and m+m' is equal to the valence of Z. In other words, all the hydroxyl groups in a polyalcohol of Z may be substituted or only some of them may be substituted.

Among the sarcosines represented by the above formulas (1) to (3), at least one compound selected from those represented by the formulas (1) and (2) is preferable in terms of a better rust preventive property. Also, only one compound may be selected from those represented by the formulas (1) to (3) and used solely, or a mixture of two or more of the compounds may be used.

The content of sarcosine represented in the formulas (1) to (3) in the rust preventive oil composition of the present invention is not particularly limited, but it is preferably 0.05 to 10% by mass, more preferably 0.1 to 7% by mass, and further preferably 0.3 to 5% by mass based on the total mass of the composition. When the content of the sarcosine is less than the above lower limit, the rust preventive property and long-term sustainability thereof tend to be insufficient. Further, when the content of the sarcosine exceeds the above upper limit, the rust preventive property and long-term sustainability thereof tend not to be improved as much as expected based on the content.

Specific examples of the (D) nonionic surfactant include alkylene glycol, polyoxyalkylene glycol, polyoxyalkylene alkyl ether, polyoxyalkylene aryl ether, fatty acid ester of polyoxyalkylene adduct of polyalcohol, polyoxyalkylene fatty acid ester, polyoxyalkylene alkylamine, alkyl alkanolamide, and the like. Among these, as the nonionic surfactant used in the present invention, alkylene glycol, polyoxyalkylene glycol, polyoxyalkylene alkyl ether, polyoxyalkylene aryl ether, and polyoxyalkylene alkylamine are preferable, and in particular, a polyoxyalkylene alkylamine is preferable, since the rust preventive oil composition of the present application exhibits a better rust preventive property.

It should be noted that one of the above nonionic surfactants may be used solely, or two or more of them may be used. Although the rust preventive oil composition of the present invention may not contain a nonionic surfactant, when it contains a nonionic surfactant, it is preferable that the content thereof be 0.01 to 10% by mass based on the total mass of the composition. In terms of the rust preventive property, the upper limit of the content is preferably 10% by mass or less, more preferably 8% by mass or less, further preferably 6% by mass or less, and most preferably 5% by mass or less.

Examples of the (E) amine include the amines exemplified in the description of the above sulfonates. Among the amines, monoamines are preferable in terms of good stain resistance, and among the monoamines, an alkyl amine, a monoamine having an alkyl group and an alkenyl group, a monoamine having an alkyl group and a cycloalkyl group, a cycloalkylamine, and an alkylcycloalkylamine are more preferable. Furthermore, in terms of good stain resistance, an amine with a carbon number of 3 or more in total in an amine molecule is preferable, and an amine with a carbon number of 5 or more in total is more preferable.

As the (F) carboxylic acid, any carboxylic acid may be used, but preferable examples thereof include a fatty acid, a dicarboxylic acid, a hydroxy fatty acid, a naphthenic acid, a resin acid, an oxidized wax, a lanolin fatty acid, and the like. Although a carbon number of the above fatty acid is not particularly limited, it is preferably 6 to 24, and more preferably 10 to 22. Further, the fatty acid may be a saturated fatty acid or an unsaturated fatty acid, and may also be a linear fatty acid or a branched fatty acid. Examples of such fatty acids include saturated and unsaturated fatty acids with a carbon number of 6 to 34.

As the dicarboxylic acid, preferably, a dicarboxylic acid with a carbon number of 2 to 40, and more preferably a dicarboxylic acid with a carbon number of 5 to 36 are used. Among these, a dimer acid obtained by dimerizing an unsaturated fatty acid with a carbon number of 6 to 18, and an alkyl or alkenyl succinic acid are preferably used. Examples of the dimer acid include a dimer acid from oleic acid. Furthermore, among the alkyl and alkenyl succinic acids, an alkenyl succinic acid is preferable, and an alkenyl succinic acid having an alkenyl group with a carbon number of 8 to 18 is more preferable.

As the hydroxy fatty acid, a hydroxy fatty acid with a carbon number of 6 to 24 is preferably used. Further, although the number of hydroxy groups in the hydroxy fatty acid may be one or more, a hydroxy fatty acid having one to three hydroxy groups is preferably used. Examples of such hydroxy fatty acids include a ricinoleic acid.

The naphthenic acid indicates carboxylic acids included in petroleum and having a —COOH group bound to a naphthene ring. The resin acid indicates an organic acid that exists in a free state or as an ester in a natural resin. The oxidized wax is one obtained by oxidizing wax. Although the wax used as a raw material is not particularly limited, specific examples of the wax include a paraffin wax, a microcrystalline wax, and petrolatum which are obtained when a petroleum fraction is refined, and a polyolefin wax which is produced by synthesis, and the like.

The lanolin fatty acid is a carboxylic acid which is obtained by refining a waxy material that adheres to wool by hydrolysis or the like.

Among these carboxylic acids, in terms of the rust preventive property, degreasing, and storage stability, a dicarboxylic acid is preferable, a dimer acid is more preferable, and a dimer acid derived from oleic acid is more preferable.

The (G) fatty acid amine salt indicates a salt formed between a fatty acid exemplified in the description of the above carboxylic acid and an amine exemplified in the description of the above amine.

Examples of the (H) carboxylate include an alkali metal salt, an alkaline earth metal salt, an amine salt and the like of the above carboxylic acids. Examples of the alkali metal which constitutes the carboxylate include sodium, potassium, and the like, and examples of the alkaline earth metal include barium, calcium, magnesium, and the like. In particular, a calcium salt is preferably used. Further, examples of the amine include the amines exemplified in the description of the amine. It should be noted that the use of a barium salt may cause insufficient safety to a human body or the ecosystem.

Examples of the (I) paraffin wax include a paraffin wax, a microcrystalline wax, and petrolatum which are obtained by refining a petroleum fraction, a polyolefin wax which is obtained by synthesis, and the like.

An oxidized wax used as a raw material for the (J) salt of oxidized wax is not particularly limited, but examples of the oxidized wax include an oxidized paraffin wax produced by oxidizing a wax such as a paraffin wax described above.

When the (J) salt of oxidized wax is an alkali metal salt, examples of an alkali metal used as a raw material include sodium, potassium, and the like. When the salt of oxidized wax is an alkaline earth metal salt, examples of an alkaline earth metal used as a raw material include magnesium, calcium, barium, and the like. When the salt of oxidized wax is a heavy metal salt, examples of a heavy metal used as a raw material include zinc, lead, and the like. In particular, a calcium salt is preferable. It should be noted that it is preferable that the salt of oxidized wax be not a barium salt or a heavy metal salt in terms of safety to a human body or a biological system.

Examples of the (K) boron compound include potassium borate, calcium borate, and the like.

Examples of the (L) alkyl or alkenyl succinic acid derivative include a reaction product of an alkyl or alkenyl succinic acid and an aminoalkanol, a reaction product of an alkyl or alkenyl succinic acid anhydride and sarcosine, a reaction product of an alkyl or alkenyl succinic acid anhydride and a dimer acid, and the like except the (B4) esters formed between an alkyl or alkenyl succinic acid and an alcohol which is exemplified in the description of the esters.

As the (M) water, any water can be used such as industrial water tap water, ion exchange water, distilled water, water treated with activated carbon or a water purifier for general household use, and water generated by absorbing moisture in the air.

A content of the (M) water is in such a range that the lower limit is 0.1% by mass and the upper limit is 10% by mass based on the total mass of the composition. The lower limit of the content of the water is 0.1% by mass or more, preferably 0.2% by mass or more, and most preferably 0.5% by mass or more in terms of suppression of rust development. Further, the upper limit of the content is 10% by mass or less, and more preferably 9% by mass or less in terms of suppression of rust development and stability against water separation.

A blending method of water is not particularly limited, but may be, for example, as follows: (1) a method in which water is premixed with a surfactant and the mixture solution is blended with a base oil; (2) a method in which water is blended and dispersed forcedly by use of a stirrer such as a homogenizer; (3) a method in which water is blended and dispersed forcedly by blowing steam into a base oil; and (4) a method in which before or after the rust preventive oil composition of the present invention is applied to a metal member, moisture in the air is naturally absorbed therein.

The rust preventive oil composition of the present invention may contain other additives, if necessary. Specific examples thereof include a sulfurized fat and oil, a sulfurized ester, long-chain alkyl zinc dithiophosphate, a phosphate ester such as tricresyl phosphate, oils and fats such as lard and vegetable oil, and derivatives thereof, a fatty acid, a higher alcohol, calcium carbonate, and potassium borate, which have an effect in improving lubricity; a phenol or amine antioxidant for improving antioxidant effect; a corrosion inhibitor for improving corrosion prevention effect, such as benzotriazole or derivatives thereof, thiadiazole, benzothiazole, and the like; an antifoaming agent such as methyl silicone, fluoro silicone, polyacrylate, and the like, a surfactant, or mixtures thereof. Among these, it is particularly preferable to use a phenol antioxidant for improving antioxidant effect, and benzotriazole or derivatives thereof as the corrosion inhibitor.

It should be noted that, although the other additives described above may be contained in any amount, the total content of these additives is preferably 10% by mass or less based on the total mass of the composition of the present invention.

Further, besides the first base oil and the second base oil, a mineral oil and/or a synthetic oil in which the kinematic viscosity at 40° C. exceeds 500 $mm^2/s$ may be further blended. In this case, it is preferable that an addition amount thereof be 5.0% by mass or less.

The purposes of the rust preventive oil composition of the present invention are not particularly limited, and the rust preventive oil composition can be preferably used for rust prevention of metallic parts after metal processing in a production process of various metallic parts such as steel plates, bearings, steel spheres, guide rails, and the like.

EXAMPLES

Hereinafter, the present invention is further explained more specifically based on Examples and Comparative Examples, but the present invention is not limited to the following Examples at all.

Examples 1 to 9, Comparative Examples 1 to 9

In Examples 1 to 9 and Comparative Examples 1 to 9, rust preventive oil compositions were prepared using respective base oils shown in Tables 1 and 2 and additives shown below. Various properties of the rust preventive oil compositions of Examples 1 to 9 and Comparative Examples 1 to 9 are shown in Table 3 and Table 4.

TABLE 1

| | Base oil | | | | | |
|---|---|---|---|---|---|---|
| | 1 | 2 | 3 | 4 | 5 | 6 |
| 5%-distillation temperature, ° C. | 163 | 214 | 433 | 343 | 501 | 133 |

TABLE 1-continued

| | Base oil | | | | | |
|---|---|---|---|---|---|---|
| | 1 | 2 | 3 | 4 | 5 | 6 |
| Difference between 5% and 9% distillation temperatures, ° C. | 26 | 10 | 117 | 109 | 180 | 27 |
| Aromatic content, % by volume | 0.3 | 0.3 | 8.5 | 4.6 | 8.3 | 0.3 |
| Naphthene content, % by volume | 64 | 32 | 26 | 29 | 25 | 53 |
| Density at 15° C., $g/cm^3$ | 0.772 | 0.791 | 0.886 | 0.862 | 0.902 | 0.759 |
| Kinematic viscosity at 40° C., $mm^2/s$ | 1.031 | 1.650 | 94.95 | 20.08 | 480 | 0.879 |

TABLE 2

| Base oil | 7 | 8 | 9 | 10 | 11 |
|---|---|---|---|---|---|
| 5%-distillation temperature, ° C. | 152 | 142 | 204 | 219 | 144 |
| Difference between 5% and 9% distillation temperatures, ° C. | 118 | 79 | 25 | 21 | 18 |
| Aromatic content, % by volume | 3.8 | 15.2 | 1.0 | 0.2 | 0.1 |
| Naphthene content, % by volume | 33 | 24 | 22 | 98 | 33 |
| Density at 15° C., $g/cm^3$ | 0.806 | 0.772 | 0.786 | 0.829 | 0.741 |
| Kinematic viscosity at 40° C., $mm^2/s$ | 1.442 | 1.399 | 1.601 | 2.045 | 0.914 |

[Additives]

<Sulfonate>

A1: calcium sulfonate (a mixture of an equal quantity of calcium sulfonate with a base number of 21 mgKOH/g and calcium sulfonate with a base number 233 mgKOH/g)

A2: ethylenediamine sulfonate

<Ester>

B1: sorbitan monooleate

B2: pentaerythritol ester of lanolin

<Other Additives>

C1: oleoyl sarcosine (N-methyloleamidoacetic acid)

D1: ethylene oxide adduct of cyclohexylamine (cyclohexyl diethanolamine)

E1: alkylamine of octanoic acid

F1: di-t-butyl-p-cresol as an antioxidant

F2: benzotriazole as a corrosion inhibitor

Then, on the rust preventive oil compositions of Examples 1 to 9 and Comparative Examples 1 to 9, evaluation tests shown below were performed.

(Rust Preventive Property)

It was evaluated in accordance with JIS K2246-2007 "Rust preventive oils," section 6.35 "Neutral salt spray test." Time (h) by which rust developed was measured for evaluation, and the evaluation was performed every hour. The obtained results are shown in Tables 3 and 4. Note that in this test, if it took 16 hours or more before rust developed, it was judged that a sufficient rust preventive property was exhibited.

(Stability of the Oil Formulation)

A rust preventive oil composition was prepared and left at rest in an air thermostat adjusted to 25° C. for a maximum of 90 days to observe separation of an oil formulation every 24 hours. The obtained results are shown in Tables 3 and 4. In Tables 3 and 4, for one with separation, time at an observation point thereof is described, and one without separation is expressed as "○."

(Smell)

A rust preventive oil composition was prepared and warmed to 40° C. to judge the smell thereof. Ten examinees judged the smell according to the following criteria: "with no smell" is scored with 5 points; "with little smell" is scored with 4 points; "with smell to some extent" is scored with 2 points; and "with significant smell" is scored with 1 point, and an average point was calculated. One with an average of 4 points or more was judged as ○, one with an average of not less than 2 points but less than 4 was judged as Δ, and one with an average of less than 2 points was judged as ×. The obtained results are shown in Tables 3 and 4.

(Skin Irritation)

After a rust preventive oil composition was prepared, commercial adhesive plasters for patch test were impregnated with 0.3 mL of the composition and were attached to 5 portions of the inside of the upper arm of a subject, and after one hour, the plasters were peeled off to observe a condition of the skin. The test was performed on ten subjects, and their conditions were scored according to the following three criteria: red (3 points); slightly red (2 points); and no change (1 point). One with an average of less than 1.5 points was judged as ○, one with an average of not less than 1.5 points but less than 2.5 points was judged as Δ, and one with an average of 2.5 points or more was judged as ×. The obtained results are shown in Tables 3 and 4.

TABLE 3

| | | Example | | | | | | | | |
|---|---|---|---|---|---|---|---|---|---|---|
| | | 1 | 2 | 3 | 4 | 5 | 6 | 7 | 8 | 9 |
| Composition, % by mass | Base oil 1 | 70 | | 70 | 70 | — | — | — | — | — |
| | Base oil 2 | — | 70 | — | — | 89 | 70 | 87 | 89.6 | 55 |
| | Base oil 3 | 2 | 2 | 2 | 2 | 2 | — | 0.5 | 0.2 | 2 |
| | Base oil 4 | 18 | 16 | 16 | 17 | 18 | 20 | 2.5 | 0.2 | 33 |
| | Base oil 5 | — | — | — | — | 1 | — | — | — | — |
| | Base oil 6 | — | — | — | — | — | — | — | — | — |
| | Base oil 7 | — | — | — | — | — | — | — | — | — |
| | Base oil 8 | — | — | — | — | — | — | — | — | — |
| | Base oil 9 | — | — | — | — | — | — | — | — | — |
| | Base oil 10 | — | — | — | — | — | — | — | — | — |
| | Base oil 11 | — | — | — | — | — | — | — | — | — |
| | A1 | 4.7 | 4.7 | — | — | 4.7 | 4.7 | 4.7 | 4.7 | 4.7 |
| | A2 | — | — | 4.7 | 4.7 | — | — | — | — | — |
| | B1 | 1 | 1 | 1 | 1 | 1 | 1 | 1 | 1 | 1 |
| | B2 | 2 | 2 | 2 | 2 | 2 | 2 | 2 | 2 | 2 |
| | C1 | 1 | 1 | 1 | 1 | 1 | 1 | 1 | 1 | 1 |
| | D1 | — | — | 1 | 1 | — | — | — | — | — |
| | E1 | 1 | 1 | 1 | 1 | 1 | 1 | 1 | 1 | 1 |
| | F1 | 0.2 | 0.2 | 0.2 | 0.2 | 0.2 | 0.2 | 0.2 | 0.2 | 0.2 |
| | F2 | 0.1 | 0.1 | 0.1 | 0.1 | 0.1 | 0.1 | 0.1 | 0.1 | 0.1 |
| | Water | — | — | 1 | — | — | — | — | — | — |
| Kinematic viscosity at 40° C., $mm^2/s$ | | 1.80 | 2.89 | 1.81 | 1.80 | 2.94 | 2.83 | 2.08 | 2.01 | 3.94 |
| Rust preventive property, h | | 21 | 25 | 23 | 21 | 27 | 19 | 20 | 16 | 17 |
| Stability of oil formulation | | ○ | ○ | ○ | ○ | ○ | ○ | ○ | ○ | ○ |
| Smell | | ○ | ○ | ○ | ○ | ○ | ○ | ○ | ○ | ○ |
| Skin irritation | | ○ | ○ | ○ | ○ | ○ | ○ | ○ | ○ | ○ |

TABLE 4

| | | Comparative Example | | | | | | | | |
|---|---|---|---|---|---|---|---|---|---|---|
| | | 1 | 2 | 3 | 4 | 5 | 6 | 7 | 8 | 9 |
| Composition, % by mass | Base oil 1 | — | — | — | — | — | — | — | — | — |
| | Base oil 2 | — | — | — | — | — | — | 90 | 79 | — |
| | Base oil 3 | 2 | 2 | 2 | 2 | 2 | 2 | — | 2 | 2 |
| | Base oil 4 | 18 | 18 | 18 | 18 | 18 | 18 | — | 18 | 87 |
| | Base oil 5 | — | — | — | — | — | — | — | — | 1 |
| | Base oil 6 | 70 | — | — | — | — | — | — | — | — |
| | Base oil 7 | — | 70 | — | — | — | — | — | — | — |
| | Base oil 8 | — | — | 70 | — | — | — | — | — | — |
| | Base oil 9 | — | — | — | 70 | — | — | — | — | — |
| | Base oil 10 | — | — | — | — | 70 | — | — | — | — |
| | Base oil 11 | — | — | — | — | — | 70 | — | — | — |
| | A1 | 4.7 | 4.7 | 4.7 | 4.7 | 4.7 | 4.7 | 4.7 | — | 4.7 |
| | A2 | — | — | — | — | — | — | — | — | — |
| | B1 | 1 | 1 | 1 | 1 | 1 | 1 | 1 | — | 1 |
| | B2 | 2 | 2 | 2 | 2 | 2 | 2 | 2 | — | 2 |
| | C1 | 1 | 1 | 1 | 1 | 1 | 1 | 1 | 1 | 1 |
| | D1 | — | — | — | — | — | — | — | — | — |

TABLE 4-continued

| | Comparative Example | | | | | | | | |
|---|---|---|---|---|---|---|---|---|---|
| | 1 | 2 | 3 | 4 | 5 | 6 | 7 | 8 | 9 |
| E1 | 1 | 1 | 1 | 1 | 1 | 1 | 1 | — | 1 |
| F1 | 0.2 | 0.2 | 0.2 | 0.2 | 0.2 | 0.2 | 0.2 | — | 0.2 |
| F2 | 0.1 | 0.1 | 0.1 | 0.1 | 0.1 | 0.1 | 0.1 | — | 0.1 |
| Water | — | — | — | — | — | — | — | — | — |
| Kinematic viscosity at 40° C., $mm^2/s$ | 1.51 | 2.51 | 2.44 | 2.78 | 3.50 | 1.57 | 1.98 | 2.35 | 22.7 |
| Rust preventive property, h | 20 | 11 | 19 | 22 | 20 | 17 | 4 | Less than 1 | 13 |
| Stability of oil formulation | ○ | ○ | 74 | 74 | ○ | ○ | ○ | ○ | ○ |
| Smell | Δ | ○ | X | ○ | X | Δ | ○ | ○ | ○ |
| Skin irritation | Δ | ○ | X | ○ | ○ | X | ○ | ○ | ○ |

The invention claimed is:

1. A rust preventive oil composition comprising:

at least one base oil selected from the group consisting of mineral oils and synthetic oils, having a 5%-distillation temperature of not less than 140° C. and not more than 250° C., a 95%-distillation temperature of 250° C. or less, a difference between the 5%-distillation temperature and the 95%-distillation temperature of 90° C. or less, an aromatic content of 5% by volume or less, a naphthene content of not less than 30% by volume and not more than 95% by volume, a density at 15° C. of 0.75 $g/cm^3$ or more, and a kinematic viscosity at 40° C. of not less than 0.3 $mm^2/s$ and not more than 5.0 $mm^2/s$;

at least one base oil selected from the group consisting of mineral oils and synthetic oils, having a 5%-distillation temperature of 260° C. or more, and a kinematic viscosity at 40° C. of not less than 6.0 $mm^2/s$ and not more than 500 $mm^2/s$; and a rust-preventing additive.

2. The rust preventive oil composition according to claim 1, wherein the rust-preventing additive is at least one selected from a sulfonate and an ester.

3. The rust preventive oil composition according to claim 1, having a kinematic viscosity at 40° C. of not less than 0.5 $mm^2/s$ and not more than 30 $mm^2/s$.

* * * * *